US011066851B2

(12) United States Patent
Perez et al.

(10) Patent No.: US 11,066,851 B2
(45) Date of Patent: Jul. 20, 2021

(54) APPARATUS FOR REMOVING A SECURITY TAG FROM AN ARTICLE

(71) Applicant: Sensormatic Electronics, LLC, Boca Raton, FL (US)

(72) Inventors: Sergio M. Perez, Lake Worth, FL (US); Patrick Claeys, Weston, FL (US)

(73) Assignee: SENSORMATIC ELECTRONICS, LLC, Boca Raton, FL (US)

( * ) Notice: Subject to any disclaimer, the term of this patent is extended or adjusted under 35 U.S.C. 154(b) by 45 days.

(21) Appl. No.: 16/578,784

(22) Filed: Sep. 23, 2019

(65) Prior Publication Data

US 2021/0087858 A1 Mar. 25, 2021

(51) Int. Cl.
*E05B 73/00* (2006.01)
*G08B 13/24* (2006.01)

(52) U.S. Cl.
CPC ..... *E05B 73/0052* (2013.01); *E05B 73/0064* (2013.01); *G08B 13/2402* (2013.01); *G08B 13/246* (2013.01)

(58) Field of Classification Search
CPC ..... E05B 73/0052; E05B 73/0017; E05B 73/0064; G08B 13/2402; G08B 13/246
USPC ..... 340/568.1, 572.1, 572.8, 572.9, 10.1
See application file for complete search history.

(56) References Cited

U.S. PATENT DOCUMENTS 5,426,419 A * 6/1995 Nguyen ..... E05B 73/0017 340/572.9
5,942,978 A * 8/1999 Shafer ..... E05B 73/0017 340/10.5
6,373,390 B1 * 4/2002 Hogan ..... E05B 73/0017 340/10.1
7,148,805 B2 * 12/2006 Hogan ..... E05B 73/0017 340/572.9
8,125,342 B2 * 2/2012 Nguyen ..... E05B 73/0064 340/572.8
8,590,349 B2 * 11/2013 Skjellerup ..... E05B 73/0017 70/57.1
8,683,830 B2 * 4/2014 Conti ..... E05B 73/0017 70/57.1
9,019,081 B2 * 4/2015 Stewart ..... E05B 73/0064 340/10.5
9,702,170 B2 * 7/2017 Favier ..... E05B 39/005
10,121,338 B2 * 11/2018 Ellers ..... G08B 13/2434
10,559,178 B2 * 2/2020 Perez ..... G08B 13/2434
10,676,968 B2 * 6/2020 Miller ..... E05B 73/0052
10,726,693 B2 * 7/2020 Alicot ..... E05B 73/0064
2002/0158762 A1 * 10/2002 Nguyen ..... E05B 73/0017 340/572.9

(Continued)

*Primary Examiner* — Adnan Aziz
(74) *Attorney, Agent, or Firm* — Arent Fox, LLP

(57) ABSTRACT

A detaching device for releasing a tack body from a tag housing is disclosed. the detaching device includes a housing, a handle pivotally mounted to the housing and configured to pivot about a handle axis. The device further includes a detacher translation mechanism configured to move a detacher portion from a first non-release position to a second release position, wherein the detacher translation mechanism converts rotational movement of the handle about the handle axis to rotational movement of the detacher portion about a first axis, wherein when the detacher portion moves to the second release position, the detacher portion is configured to be received by a receiving portion of the tag housing thus releasing the tack body from the tag housing.

20 Claims, 7 Drawing Sheets

(56) References Cited

U.S. PATENT DOCUMENTS

| | | | | |
|---|---|---|---|---|
| 2005/0091809 | A1* | 5/2005 | Xue | E05B 73/0064 24/704.1 |
| 2007/0024448 | A1* | 2/2007 | Sayegh | E05B 73/0017 340/572.1 |
| 2009/0064734 | A1* | 3/2009 | Zinner | E05B 73/0017 70/57.1 |
| 2009/0128331 | A1* | 5/2009 | Lopez | E05B 73/0017 340/572.1 |
| 2009/0128341 | A1* | 5/2009 | Skjellerup | E05B 73/0017 340/572.9 |
| 2012/0304710 | A1* | 12/2012 | Sayegh | E05B 73/0029 70/19 |
| 2014/0240129 | A1* | 8/2014 | Bergman | E05B 73/0047 340/572.9 |
| 2019/0206213 | A1* | 7/2019 | Lercari | G08B 13/246 |

* cited by examiner

APPARATUS FOR REMOVING A SECURITY TAG FROM AN ARTICLE

FIELD OF THE INVENTION

The present disclosure relates generally to an apparatus for removing a security tag from an article.

BACKGROUND

An Electronic Article Surveillance (EAS) system is designed to prevent unauthorized removal of an item from a controlled area. A typical EAS system may comprise a monitoring system and one or more security tags. The monitoring system may create a surveillance zone at an access point for the controlled area. A security tag may be fastened to a monitored item, such as an article of clothing. If the monitored item enters the surveillance zone, an alarm may be triggered indicating unauthorized removal.

The security tag may be fastened to a number of different items at different times. It may be desirable for a system to allow authorized release of the security tag, while making unauthorized release relatively difficult. Consequently, there may be a need for improved techniques in security tags in general, and removal systems for security tags in particular.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

In accordance with an aspect of the disclosure, a detaching device for releasing a tack body from a tag housing is disclosed. The detaching device includes a housing, a handle pivotally mounted to the housing and configured to pivot about a handle axis. The device further includes a detacher translation mechanism configured to move a detacher portion from a first non-release position to a second release position, wherein the detacher translation mechanism converts rotational movement of the handle about the handle axis to rotational movement of the detacher portion about a first axis, wherein when the detacher portion moves to the second release position, the detacher portion is configured to be received by a receiving portion of the tag housing thus releasing the tack body from the tag housing.

In accordance with another aspect of the disclosure, a detaching device for releasing a tack body from a tag housing is disclosed. The detaching device includes a housing, a hook configured to be movable from a first non-release position to a second release position, wherein in the second release position the hook is configured to be received by a hook receiving portion of the tag housing. The device further includes a handle moveably mounted to the housing, wherein movement of the handle causes the hook to move from the first non-release position to the second release position and a tag housing receiving portion. The device further includes an interlock member moveable from a first position when the tag body is placed within the receiving portion and a second position when the tag body is removed from the receiving portion, wherein when the interlock member is in the second position the interlock member prevents the handle from moving and the hook from moving from the first non-release position to the second release position.

Additional advantages and novel features of these aspects will be set forth in part in the description that follows, and in part will become more apparent to those skilled in the art upon examination of the following or upon learning by practice of the disclosure.

BRIEF DESCRIPTION OF THE DRAWINGS

The novel features believed to be characteristic of aspects of the disclosure are set forth in the appended claims. In the description that follows, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advantages thereof, will be best understood by reference to the following detailed description of illustrative aspects of the disclosure when read in conjunction with the accompanying drawings, wherein:

DETAILED DESCRIPTION

Figure 1A:
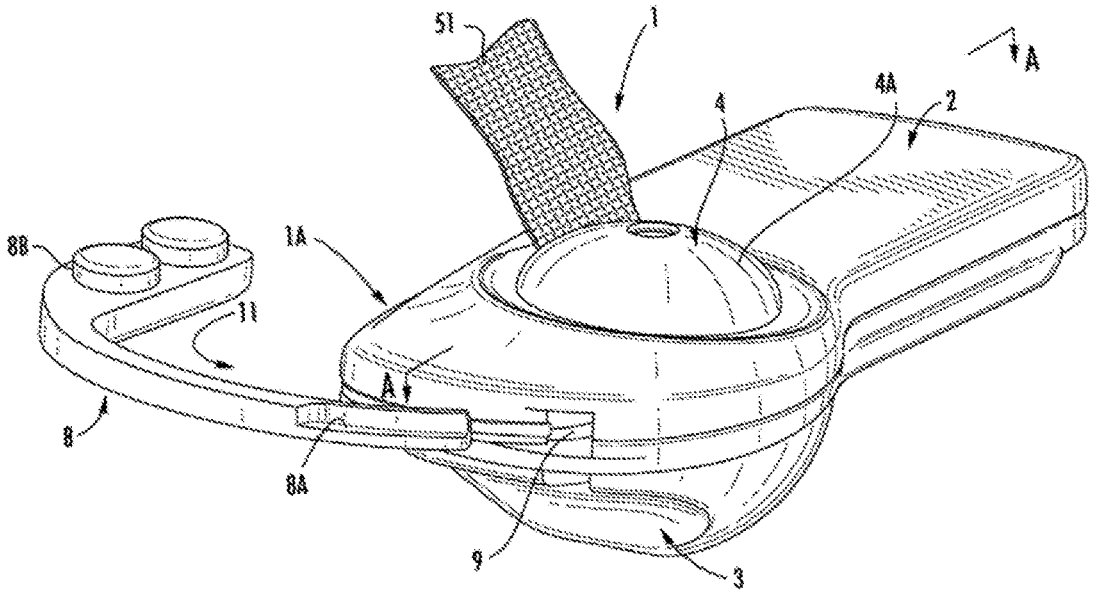
FIG. 1A is an example EAS tag that is useful for understanding the current disclosure.

The following includes definitions of selected terms employed herein. The definitions include various examples and/or forms of components that fall within the scope of a term and that may be used for implementation. The examples are not intended to be limiting. Further, it will be obvious to one skilled in the art that the present invention may be practiced without these specific details. In other instances, well-known methods, procedures, and components have not been described in detail so as to not unnecessarily obscure aspects of the present invention.

For purposes of the disclosure, directional terms are expressed generally with relation to a standard frame of reference when the detaching device is installed and in an in-use orientation.

The instant disclosure relates to a method and apparatus for the removal of EAS tags useable with an EAS system or systems. EAS systems are used for inventory control and to prevent theft and/or similar unauthorized removal of articles from a controlled area. Typically, in such systems a system transmitter and a system receiver are used to establish a surveillance zone which must be traversed by any articles being removed from the controlled area.

An EAS security tag is affixed to an article and includes a marker or sensor adapted to interact with a signal being transmitted by the system transmitter into the surveillance zone. This interaction causes a further signal to be established in the surveillance zone and the signal may be received by the system receiver. Accordingly, upon movement of a tagged article through the surveillance zone, a signal will be received by the system receiver, identifying the unauthorized presence of the tagged article in the zone. Certain types of EAS security tags have been designed to be reusable and, thus, include releasable attachment devices for affixing the tags to the articles. Such attachment devices are further designed to be releasable by authorized personnel only so that unauthorized removal of a tag from a corresponding article is avoided. To this end, many attachment devices are made releasable only through the use of an associated special tool or detaching mechanism.

Attachment devices for EAS security tags include a wide variety of different latching mechanisms designed to prevent unauthorized personnel from removing the EAS security tag from merchandise. The stimulus needed to unlatch an EAS security tag depends upon the particular latching mechanism in use. Accordingly, a variety of different detaching units utilize various means to separate reusable, removable EAS security tags from articles of merchandise. Systems for unlatching EAS security tags include devices which may apply a force to one or more latching components of the EAS security tag. The force can be applied directly to the one or more latching components via a mechanical element (e.g. a probe or hook inserted into the tag) unlatching the tag and/or indirectly via magnet, for example. Regardless of how the force is applied, the result is a disengagement of a latching element that was previously engaged with an attachment pin in the tag, thereby allowing the tag to be removed from the article.

Aspects of the disclosure are described with reference to the attached figures. The figures are not drawn to scale and they are provided merely to illustrate the instant disclosure. Several aspects of the disclosure are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the disclosure. The disclosure is not limited by the illustrated ordering of acts or events, as some acts may occur in different orders and/or concurrently with other acts or events. Furthermore, not all illustrated acts or events are required to implement a methodology in accordance with the disclosure.

Figure 1B:
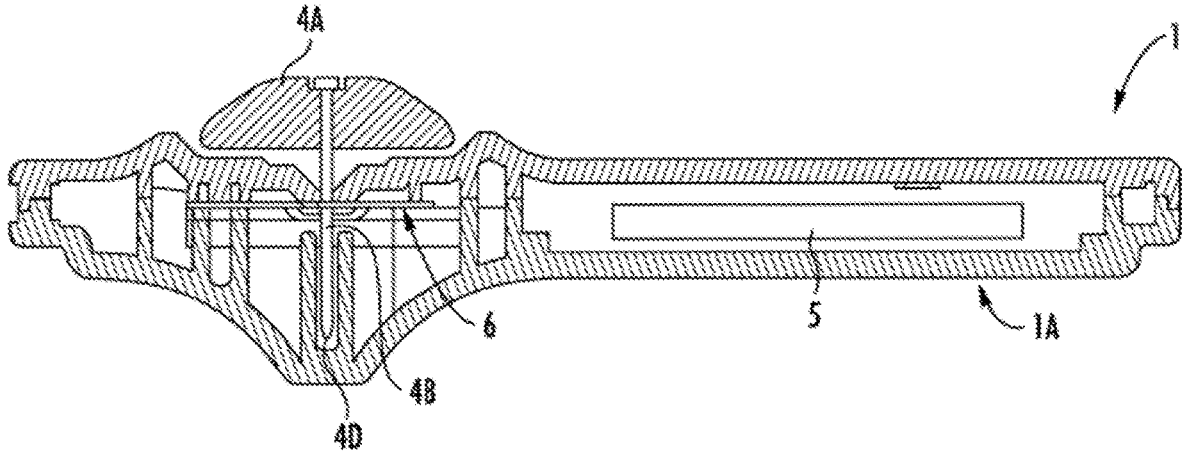
FIG. 1B is a cross-sectional view of the EAS tag in FIG. 1, taken along line A-A.

FIGS. 1A and 1B show one example of an EAS security tag 1. The invention is not limited to use with an EAS security tag 1 as shown, but a brief description of such an exemplary tag is useful for understanding the inventive arrangements. The tag 1 includes an upper housing 2 and a lower housing 3 which are joined along corresponding side walls to form a closed tag body 1A. The tag 1 further includes a tack assembly 4 having an enlarged tack head 4A, an elongated tack body 4B, and a pointed tip 4D (see, FIGS. 1, and 2). The tack assembly 4 is used to attach the tag body 1A to an article 51 which is to be protected by the EAS tag 1. In order to detect the presence of the tag 1, an EAS sensor 5 is provided which generates detectable signals. For example the EAS sensor 5 can be an acoustically resonant magnetic sensor. A wide variety of EAS sensors are known in the art and therefore such sensors will not be described here in detail. However, it should be understood that any suitable EAS sensor can be provided in the EAS security tag 1.

The article 51 is joined to the tag body 1A by the tack assembly 4 by inserting the tack body 4B into an opening in the wall of the upper housing 2. When the tack body 4B is fully inserted, the pointed end of the tack is received in an upstanding cavity or collar extending from an inner surface of the lower housing 3. The tack head 4A, in turn, seats in a recessed area in the upper housing 2. The article 51 is thus held between the tack head 4A and the housing (e.g., upper housing 2 of tag body 1A). A locking element 6 is provided within the tag body for releasably preventing the tack body 4B from being withdrawn from the tag body. The tack assembly 4 and the article 51 thus become releasably locked to the EAS tag 1.

A hook 8 may be needed to reach and release the locking mechanism inside the security tag and, thus, detach the tack assembly 4 and the article 51 from the tag body 1A. In one example, the tag body 1A is configured so that access to the internal locking mechanism is through an arcuate channel accessible through a curved slot 9 defined by one or more inner walls of the tag body 1A. In order to release the tack 4 from the tag body 1A, the hook 8 is introduced into the slot opening 9 of the tag body 1A via rotation of the hook about its rearward end 8B. The rotation is indicated by arrow 11 in FIG. 1A. This action causes the hook 8 to be inserted within the tag 1 until a forward end 8A of the hook 8 reaches and passes into the inner end of the curved slot to effect the unlocking operation. Some additional EAS tags that are usable with the current disclosure may include but are not limited to: SuperTag Ink®, SuperTag®, SuperTag II®, and/or SuperTag II®, all manufactured by Sensormatic of Baca Raton Florida.

An automated or electronic device may be used to remove EAS security tags (e.g., tag 1) from an article (e.g., article 51). A power actuated detaching assembly may be configured to automatically insert the hook 8 within a tag body 1A. This action occurs automatically when the tag 1 is placed in a cradle area of a detaching assembly which is specifically designed for unlocking the tack assembly 4 from the tag body 1A. Upon detecting a tag in the cradle area, these devices automatically rotate the hook 8 into position, pause momentarily during a preset dwell time to allow the user to remove the tack assembly from the tag body, and then retract the hook 8 from the body. In such systems a user must exactly time the manual operations of detachment operation based only on the user's acquired experience with the preset dwell time of the particular device. If the user is not familiar with the timing of these operations, they may attempt to remove the tag during periods other than the dwell time, thereby resulting in damage to the tag and/or detaching assembly. Thus, a problem associated with automatic removal of EAS security tags from articles is a high percentage of failed detachment operations, which may be due to a user moving the EAS security tag or prematurely pulling the EAS tag away from the automated device before a removal operation is complete. One factor determined to cause such user error may involve poor user feedback when an electronic removal device is used. Thus, in an aspect of the current disclosure, a removal device is disclosed that allows the user of the device to control the rotation and retraction of hook 8, which may prevent user error associated with automatic or automated EAS security tag removal devices. Further, efficiency of the removal process may be decreased due to lack of user feedback with some electronic detachers. For example, if the tack is not pulled out from the tag body 1A quickly enough during a detaching process, the hook 8 may retract preventing the tack from being fully released from tag body 1A.

Figure 2A:
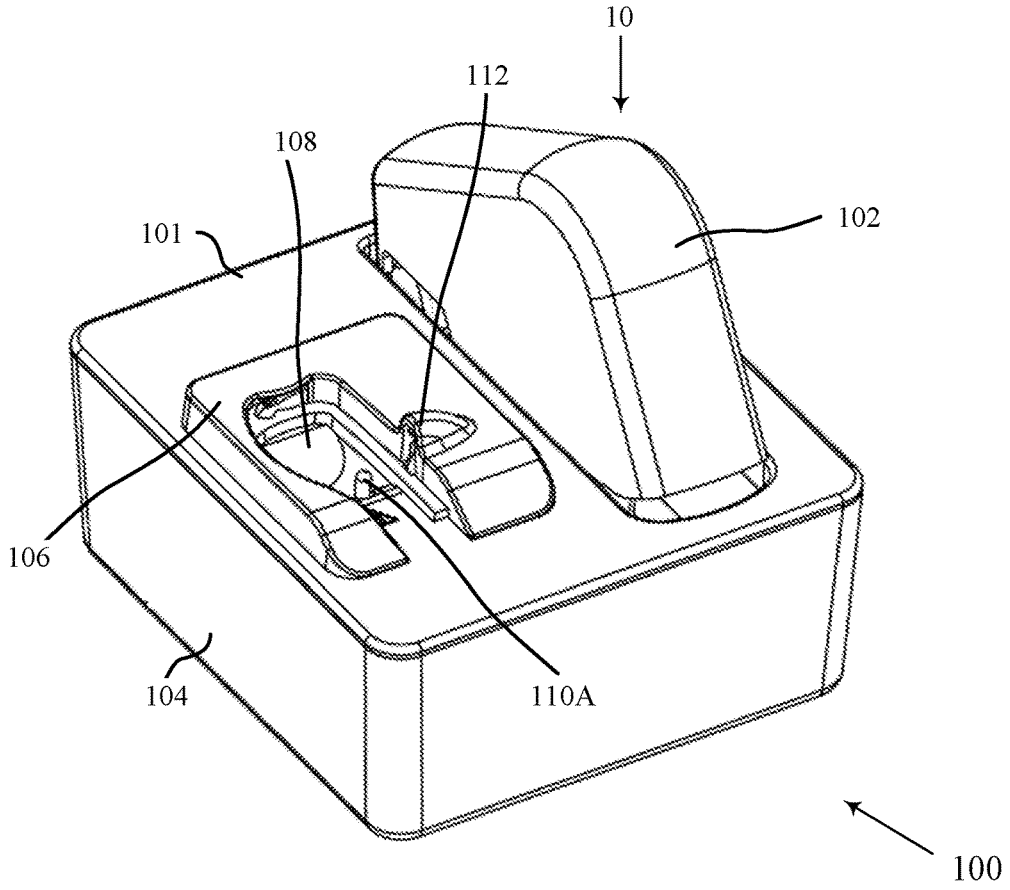
FIG. 2A a top perspective view of an example EAS tag detaching device in a first state of operation.
Figure 2B:
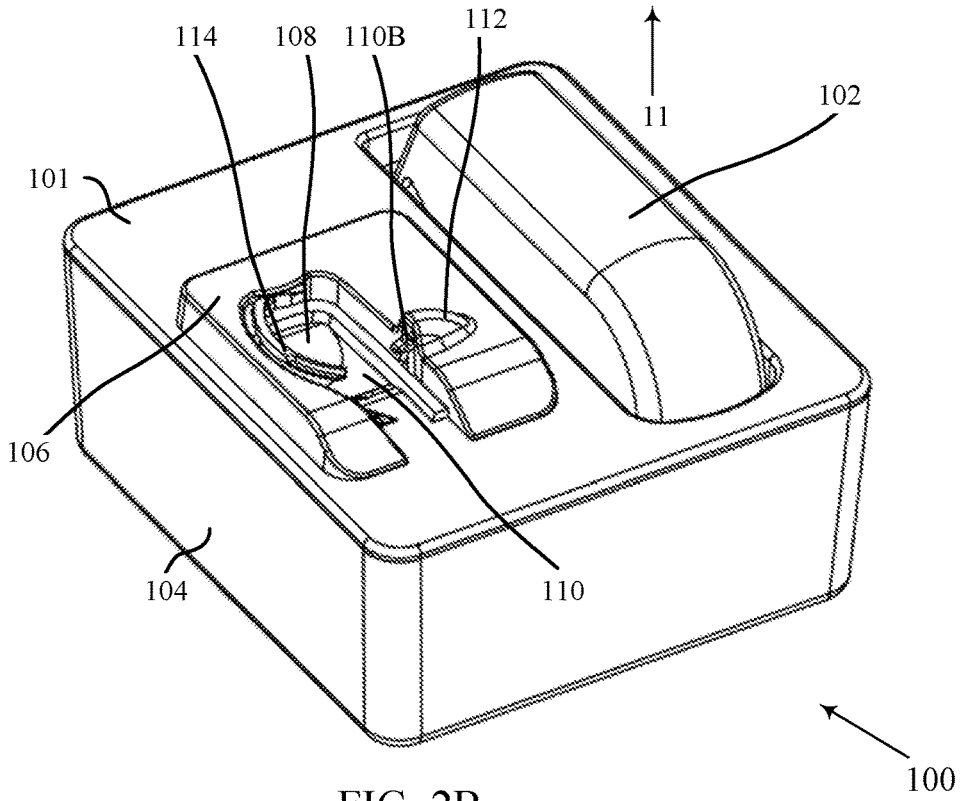
FIG. 2B a top perspective view of the example EAS tag detaching device of FIG. 2A in a second state of operation.
Figure 3A:
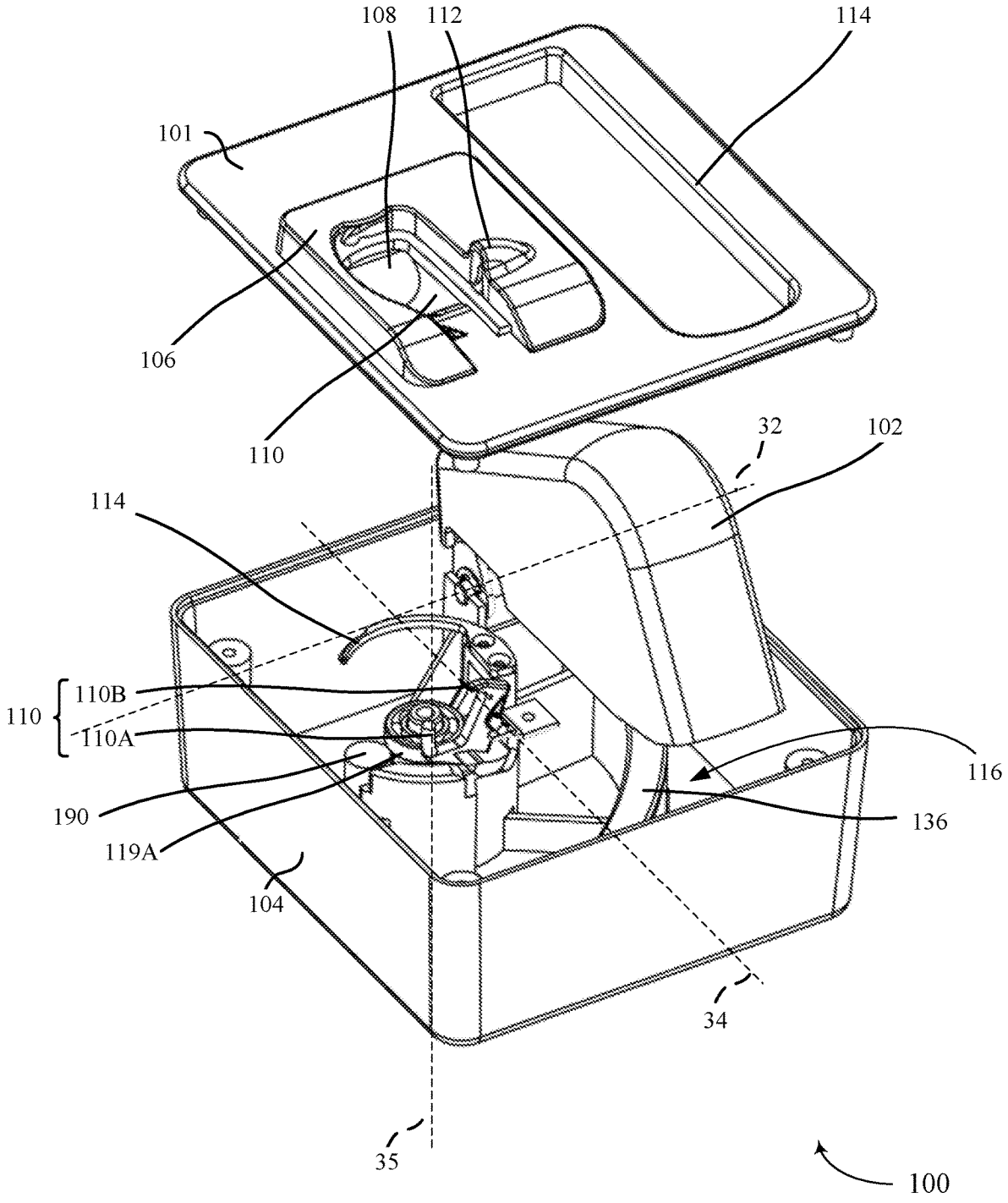
FIG. 3A a partial exploded view of the example EAS tag detaching device of FIGS. 1A-2B in a first state of operation.

FIGS. 2A and 2B show a perspective view of an EAS tag detaching device 100 in accordance with the current disclosure. It is noted that throughout the disclosure the term EAS tag detaching device and detaching device may be used interchangeably. The detaching device 100 may include an outer handle 102. The detaching device 100 may further include a bottom outer casing 104 and a top outer casing 101 configured to fit within and form an enclosure or unitary structure with the bottom outer casing 104. The top outer casing 101 may have a concave portion 108 that is configured to receive a lower housing of an EAS tag (e.g., lower housing 1A in FIG. 1A). The top outer casing 101 may have a receiving portion cover 106 mounted thereto. While throughout the disclosure the receiving portion cover 106 is referred to as a separate component, in one example the top outer casing 101 and the receiving portion cover 106 may be formed as a single unitary component. The receiving portion cover 106 may include a convex portion 112 configured to cover a holder portion 110B of an interlock member 110 (FIG. 3A). The interlock member 110 may further include a protruding portion 110A that is configured to be pressed in a downward direction (e.g., direction 10) when an EAS tag is placed within the concave portion 108 of the top outer casing 101.

For context, a brief overview of the function of an example of a detaching device 100 in accordance with an aspect of the disclosure will be described with reference to FIGS. 2A and 2B. Further detail of the mechanisms and interoperation of components that may allow for the described function of the detaching device 100 will be described in further detail below with reference to FIGS. 3A-8. FIGS. 2A and 2B show a respective first state and a second state of the detaching device 100. In the first state (FIG. 2A) the detaching device is configured to receive an EAS tag (e.g., EAS tag 1 in FIGS. 1A and 1B). In operation, a user may place the lower housing (e.g., lower housing 1A in FIG. 1A) of an EAS tag into the concave portion 108 of the top outer casing 101. Placement of the EAS tag into the concave portion 108 of the top outer casing 101 may cause a portion of the EAS tag to press downward on the protruding portion 110A of the interlock member 110. Once the EAS tag is placed within the concave portion 108 of the top outer casing 101 and held in place, a user may press downward (e.g., direction 10 in FIG. 2A) on the outer handle 102. Pressing downward 10 on the outer handle 102 may cause the holder portion 110B of the interlock member 110 to press down and/or further prevent movement of the tag via contact with the upper housing (e.g., upper housing 2 in FIG. 1A) of the EAS tag. Further pressing the outer handle 102 in downward direction 10 causes the hook 114 to rotate from a retracted position, which may hereinafter be interchangeably referred to as a first non-release position or first position, as shown in FIG. 2A to a second release position, which may hereinafter be interchangeably referred to as a release position as shown in FIG. 2B. Movement of the hook 114 from the non-release position shown in FIG. 2A to the second release position shown in FIG. 2B causes introduction of the hook 114 into the slot opening (e.g., reference 9 in FIG. 1A) of the tag body thus unlocking the tack assembly 4 from the tag body 1A. The tack assembly 4 and article 51 may then be removed from the EAS tag body while the tag is held within the detacher by holder portion 110B. Release of the outer handle 102 causes the outer handle 102 to move in an upward direction 11, and causes movement of the hook 114 back to the retracted or non-release position shown in FIG. 2A. In addition, the upward movement of the outer handle 102 further causes the holder portion 110B to rotate out of contact with the EAS tag allowing for release of the EAS tag from the detacher.

Figure 3B:
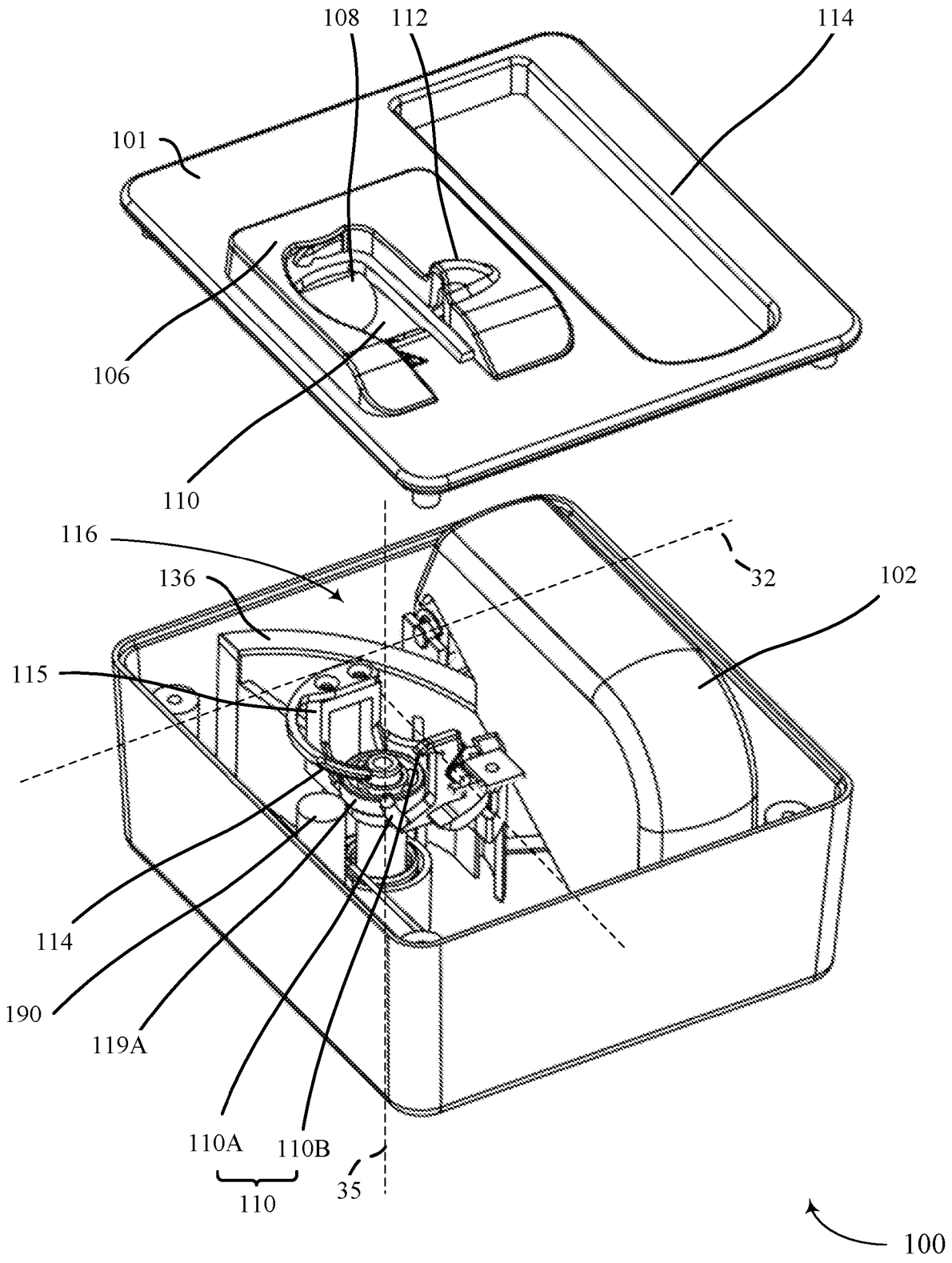
FIG. 3B a partial exploded view of the example EAS tag detaching device of FIGS. 1A-2B in a second state of operation.
Figure 4:
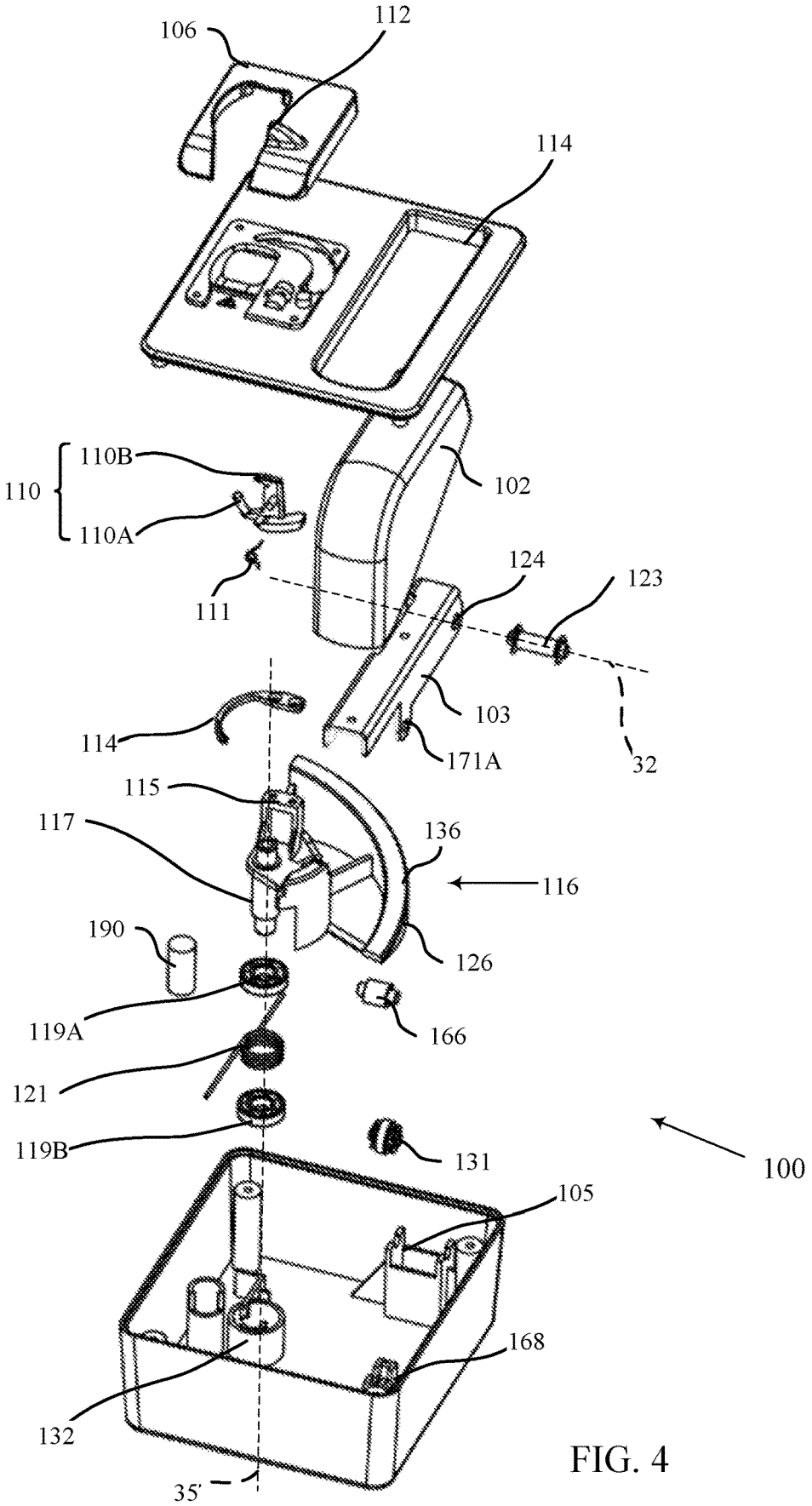
FIG. 4 is an exploded view of the example EAS tag detaching device of FIGS. 1A-3B.

FIGS. 3A and 3B, show examples of FIGS. 2A and 2B, respectively, with the top outer casing 101 removed. FIG. 4 is an exploded view of the components in detaching device 100. As mentioned above, the detaching device 100 may include a bottom outer casing 104 configured to receive the top outer casing 101. The top outer casing 101 may have a concave portion 108 that is configured to receive a lower housing of an EAS tag (e.g., tag 1 in FIG. 1A). The top outer casing 101 may have a receiving portion cover 106 mounted thereto. The device 100 may include a rotating member 116 configured to rotate about a first axis 35 causing the hook 114 to rotate from a first retracted position (e.g., as shown in FIG. 3A) to a second release position (e.g., as shown in FIG. 3B). The rotating member 116 may be rotatably coupled with the bottom casing 104 via a rotating portion receiving portion 132 (FIG. 4) in the bottom casing 104. Furthermore, the rotating member 116 may include a shaft 117 configured to receive a series of rotary support members 119A and/or 119B. Either one of the rotary support members 119A and/or 119B may for example be a bushing, a ball bearing, a conical bearing, a thrust bearing, and/or any other type of bearing or bushing known in the art.

The rotating member 116 may further include a cam 126 with a first angled camming surface 136. In one aspect, the first angled camming surface 136 may curve around the first axis 35. The cam 126 and camming surface 136 may interact with a cam follower 166. The rotating member 116 may further include a hook mounting portion 115 configured to have the hook 114 mounted thereto. The hook mounting portion 115 may for example include two threaded holes configured to receive series of screws (not shown) passed through holes in one end of the hook 114. While the hook 114 may be mounted to the hook 114 in the aforementioned fashion, the example given above is not intended to be limiting. For example, the hook may also be coupled with the rotating member 116 via an adhesive and/or a series of rivets or other fasteners, to name a few examples.

As shown in FIG. 4, the outer handle 102 may be mounted to an inner handle 103. In one example, the outer handle may be formed of a different material then the inner handle. For example, the outer handle 102 may be formed of a material such a as plastic or rubberized plastic for ergonomics, while inner handle 103 may be formed of a metal to provide structural support or integrity when a user presses downward (e.g., direction 10 in FIG. 2A) on a handle (e.g., outer handle 102) to release the EAS security tag from an article. The outer handle 102 may be fastened to the inner handle 103 via a friction fit and/or snap fit and/or via an adhesive or fasteners. The inner handle 103 may be pivotaby mounted to a handle mounting portion 105 in the bottom outer casing 104. In one example, the inner handle 103 may be mounted to the handle mounting portion 105 via a rod 123 with a circular groove at either end provided through handle through-hole 124 and held captive via a circlips or snap-rings (e.g., circlip 125A in FIGS. 5 and 6 and circlip 125B in FIG. 7). Thus, the aforementioned mounting of the inner handle 103 allows the inner handle 103 and outer handle 102 to pivot about a second axis 32, which may hereinafter be interchangeably referred to as a handle axis, and which may be perpendicular to first axis 35. In another example, the inner handle 103 may be mounted to the bottom outer casing via bearings or bushings, to name a few additional examples.

The inner handle 103 may further include or have rotatably mounted thereto a cam follower 166. In one example, the cam follower 166 may be a rotary element that is rotatably mounted to a set of cam follower mounting holes 171A and 171B in the inner handle 103. The cam follower 166 may be cylindrically shaped with distal ends having a reduced diameter to fit within the cam follower 166 mounting holes 171A and 171B thus allowing the cam follower 166 to rotate about a third axis 33 (FIGS. 5-7), which may hereinafter be interchangeably referred to as a cam follower axis, with relation to the inner handle 103. While not shown in the Figures, the cam follower 166 may also include circular grooves at either end of the cam follower 166 that may be provided with circlips or snap-rings (e.g., similar or equivalent to circlip 125A in FIGS. 5 and 6 and circlip 125B in FIG. 7), for example. In one example, the cam 126 may be rotatably supported with relation to inner handle 103 via a single or multiple bushing(s), ball bearing(s), conical bearing(s), and/or any other type of bearing or bushing known in the art.

Figure 5:
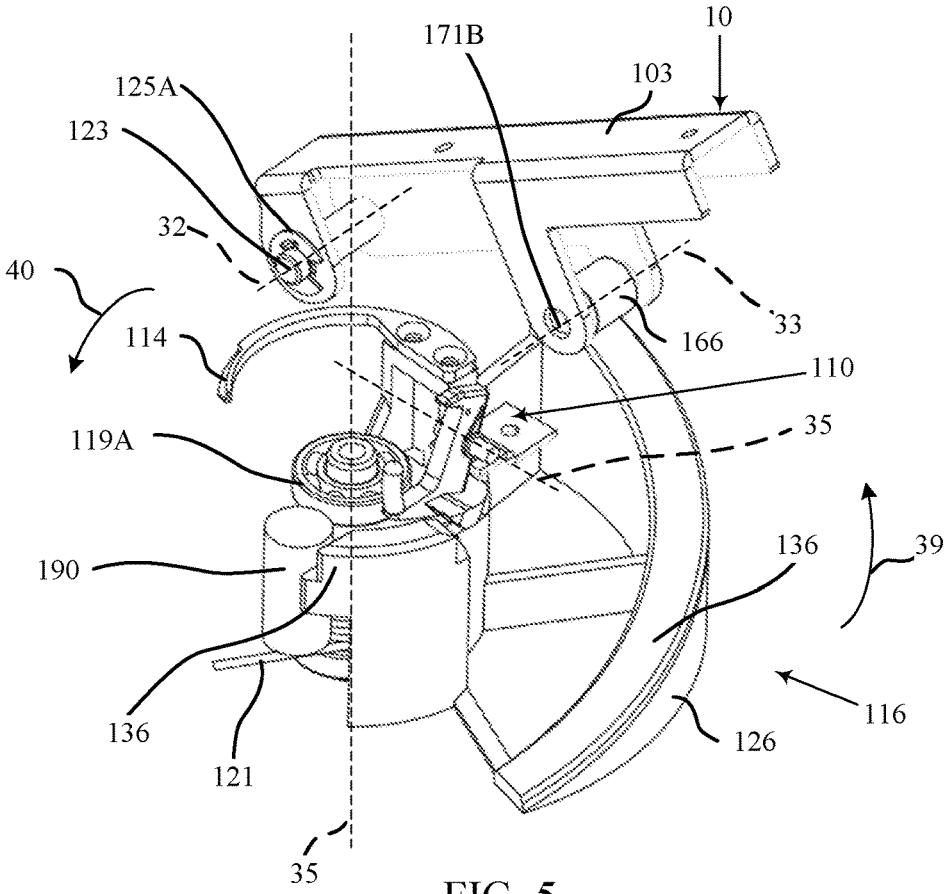
FIG. 5 is a perspective view of a portion of the EAS tag detaching device of FIGS. 1A-4 in a first state of operation.
Figure 6:
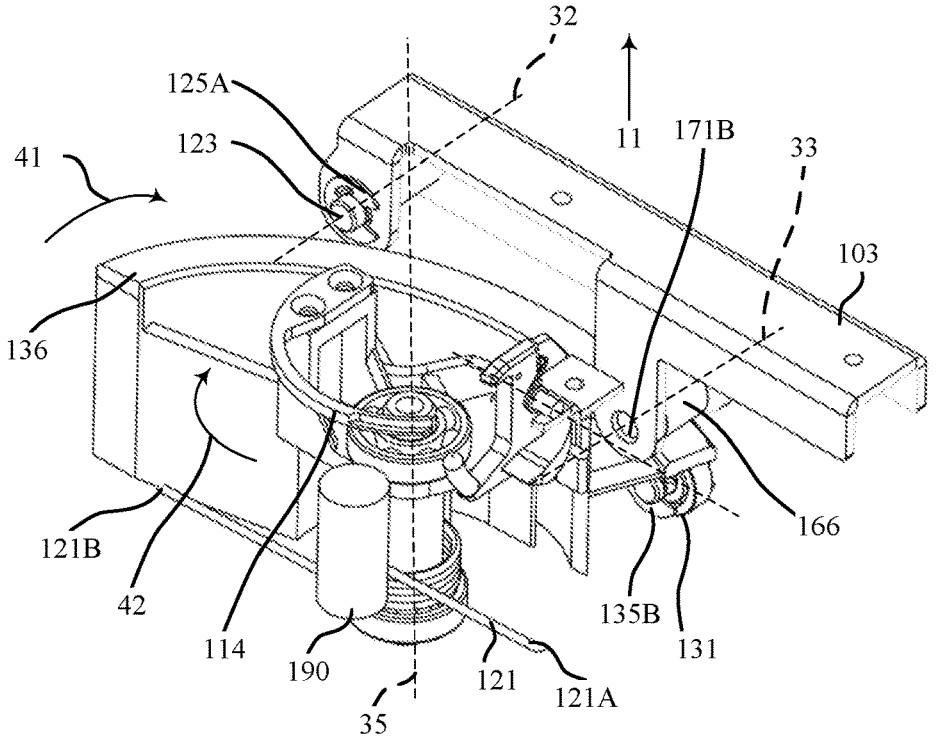
FIG. 6 is a perspective view of a portion of the EAS tag detaching device of FIGS. 1A-5 in a second state of operation.

FIGS. 5 and 6 include example components or a translation mechanism, which may convert rotational movement of the handle to a movement of the hook 8 from a non-release position to a release position, for example. Turning to FIGS. 5 and 6, the aforementioned structure causes the cam follower 166 to roll along and apply a force to a camming surface 136 of the cam 126. Thus, when the handle (e.g., inner handle 103 or outer handle 102) is pressed downward (e.g., in direction 10) by a user, a linear force applied to camming surface 136 by the inner handle 103 is converted to a rotational force via the interaction between the cam follower 166 and camming surface 136 causing the rotating member 116 to rotate in direction 39 about first axis 35. Thus, pressing the inner handle 103 in a downward direction (e.g., direction 10 in FIG. 5) causes the hook 114 to rotate in direction 40 from a non-release position (e.g., as shown in FIG. 2A) to a release position (e.g., as shown in FIG. 2B). It is noted that the aforementioned structure is not limiting. For example, the rotational motion of the hook may be effected by a detacher translation mechanism that comprises a first gear operatively connected to the handle and a second gear operatively connected to the detacher portion, wherein rotation of the first gear causes rotation of the second gear causing the detacher portion to move from the first non-release position to the second release position, to name another non-limiting example. In another example, the detacher translation mechanism may include a first friction member operatively connected to the handle and a second friction or friction receiving member operatively connected to the detacher portion, wherein rotation or translation of the first friction member causes movement of the friction receiving member and causing the detacher portion to move from the first non-release position to the second release position.

Turning to FIG. 6, the rotating member 116 may be biased in direction 41 by a biasing member 121. As shown in FIGS. 4-6, and 8, an example of the biasing member 121 may include a torsion spring with an eyelet configured to receive the shaft 117 of the rotating member 116. A first end 121A of the biasing member 121 may be held stationary or captive at the first bottom outer casing 104 and a second end 121B of the biasing member 121 and may contact or be received by a receiving portion of the rotating member 116. Thus, the biasing member 121 may impart a rotational return force to the rotating member 116. Accordingly, when a user releases pressure applied to the handle (e.g., outer handle 102 or inner handle 103), the biasing member causes the rotating member 116 to rotate in direction 41 (FIG. 6), which causes the hook to rotate in direction 41 from the second release position to the non-release position. In addition, the rotation of rotating member 116 in direction 41 causes the cam surface 136 to impart an upward force in direction 11 on the cam follower 166 causing the inner handle 103 and outer handle 102 to move upward.

In addition to the features above, the detaching device 100 may further include a rotating portion support member 131. The rotating portion support member 131 may be rotatably supported at a support member mounting portion 168 of the bottom outer casing 104. The rotating support member 131 may contact a bottom surface 127 (FIG. 7) of the rotating member 116 and provide support to and/or allow for easier rotation of the rotating member 116. The rotating support member 131 may be rotatably via a rod 134 (FIGS. 6 and 7) with a circular groove at either end and held captive within the support member mounting portion 168 (FIG. 4) via a circlips or snap-rings (e.g., circlip 135A in FIG. 7 and circlip 135B in FIG. 6). The rotating portion support member 131, may for example, include or be comprised of a single or multiple bushing(s), ball bearing(s), conical bearing(s), and/or any other type of bearing or bushing known in the art.

Figure 7:
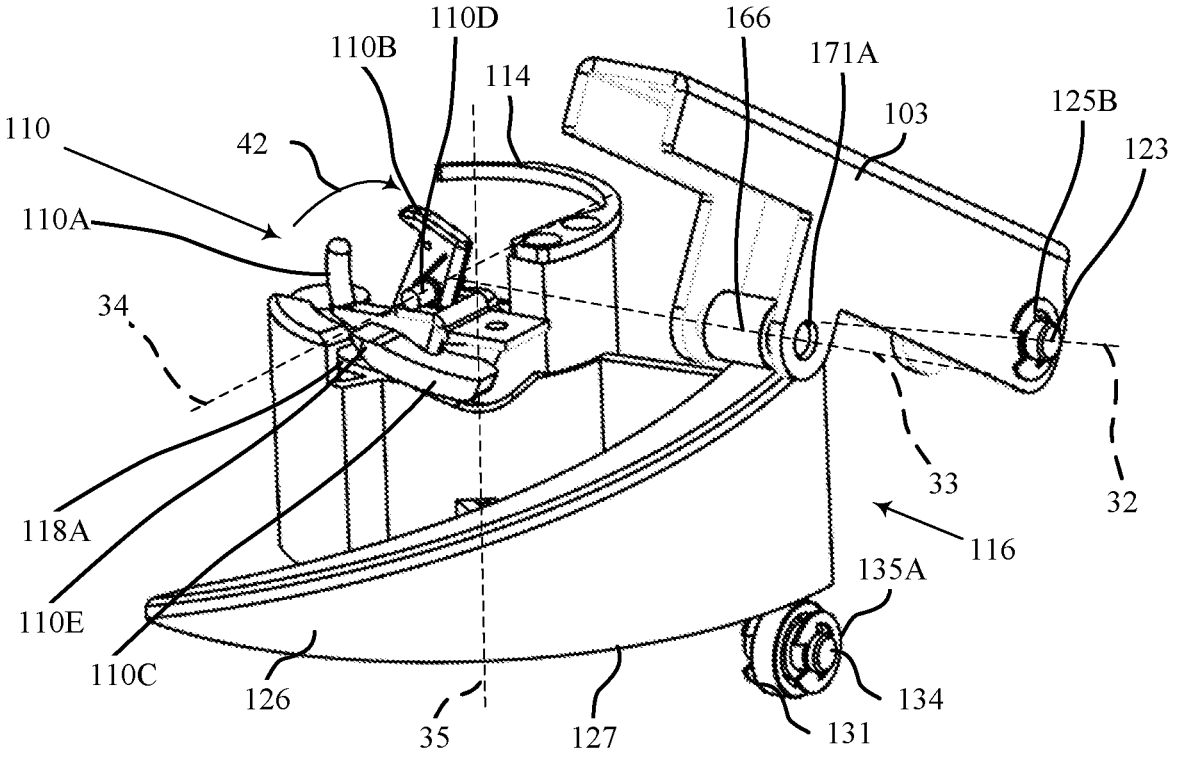
FIG. 7 is a perspective view of a portion of the EAS tag detaching device of FIGS. 1A-6 in a first state of operation.
Figure 8:
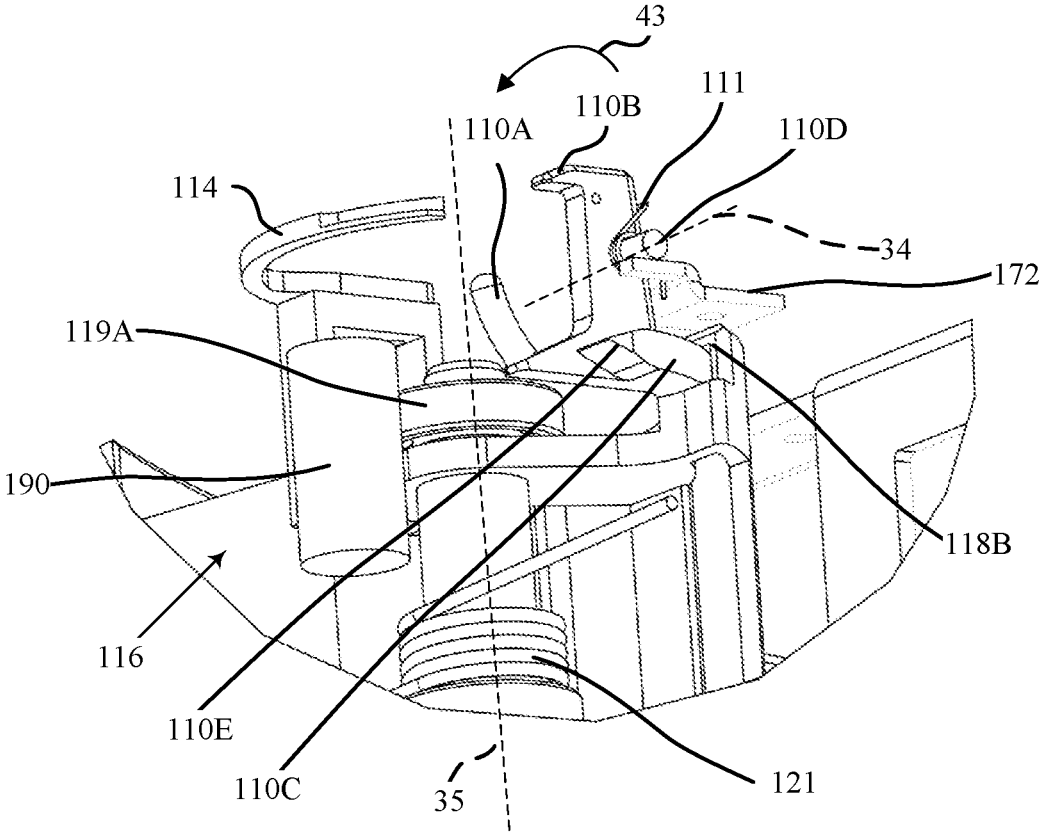
FIG. 8 is a partial perspective view of a portion of the EAS tag detecting device of FIGS. 1A-7.

As mentioned above, the detaching device 100 may further include an interlock member 110 (FIGS. 3A, 3B, 4, 7, and 8). The interlock member 110 may include a protruding portion 110A, a holder portion 110B, and may be pivotally mounted to the top outer casing via an interlock mount 172. The interlock member 110 may further include a rail 110C (FIGS. 7 and 8) with a tapered end 110E that is configured to be received at a first track end 118A (FIG. 7) of the rotating member 116. The first track end 118A may extend to a second track end 118B (FIG. 8) and may be configured to selectively receive and guide the tapered end 110E and the rail 110C of the interlock member 110. In addition, the interlock member 110 may be configured to pivot about a fourth axis 34, which may hereinafter be interchangeably referred to as an interlock axis. A biasing member 111, which may for example be a torsion spring, may bias the interlock member 110 in direction 42 (FIG. 7). The aforementioned structure may prevent the inner handle 103 or outer handle 102 from being pressed in a downward direction (e.g., direction 10 in FIG. 5), and prevent the hook 114 from moving from the non-release position to the release position without a suitable EAS tag (e.g., tag 1 in FIGS. 1A and 1B) being placed into the concave portion 108 (FIGS. 2A-2B) of the top outer casing 101. Further details of the function of the interlock member 110 are described in further detail in the example use of device 100 described below.

When in use, placement of an EAS tag (e.g., tag 1 in FIGS. 1A and 1B) into the concave portion 108 (FIGS. 2A-2B) of the top outer casing 101 may cause a portion of the EAS tag to press downward on the protruding portion 110A of the interlock member 110. Once the EAS tag is placed within the concave portion 108 of the top outer casing 101 and held in place, the interlock member 110 rotates in direction 43 (FIG. 8) about fourth axis 34, thus causing the tapered end 110E of the rail 110C to be receivable at the first track end 118A. Once the rail 110C is received within track end 118A, the rotating member 116 may be rotated in direction 41 (FIG. 6) and the interaction between the track 118A-B and rail 110C causes the holder portion 110B of the interlock member 110 to press down on and/or further prevent movement of the tag via contact with the upper housing (e.g., upper housing 2 in FIG. 1A) of the EAS tag while the hook 114 moves from the non-release position to the release position. Thus, when an EAS tag is properly inserted into the device and a user presses downward on outer handle 102, the EAS tag is held in position by the holder portion 110B of the interlock member until the handle is released and allowed to move in the upward position (e.g., direction 11 in FIG. 6) by a user. On the other hand, if an EAS tag (e.g., tag 1 in FIGS. 1A and 1B) is not properly placed or not placed at all into the concave portion 108 (FIGS. 2A-2B) of the top outer casing 101, the interlock 110 member remains in the position shown in FIG. 7 due to the biasing force applied by biasing member 111. As shown in FIG. 7, if the interlock member 110 remains rotated in direction 42, the tapered portion 110E of rail 110C does not align with the first track end 118A, which prevents rotation of the rotating member 116 due to interference between the interlock member 110 and the first track end 118A of the rotating member. Accordingly, if an EAS tag (e.g., tag 1 in FIGS. 1A and 1B) is not properly placed or not placed at all into the concave portion 108 (FIGS. 2A-2B) of the top outer casing 101, the inner handle 103 is prevented from moving in the downward direction (e.g., direction 10 in FIG. 5) thus preventing the hook 114 from moving from the first non-release position to the release position.

It is noted that any one of or a combination of the aforementioned features may be usable within an EAS tag removal device (e.g., device 100). For example, the aforementioned interlock member 110 may be omitted. Likewise, additional features may be included to either serve as secondary security features and/or to interact with features within the EAS tag e.g., tag 1 in FIGS. 1A and 1B) to allow for the release of the tack body (e.g., 1A in FIGS. 1A-1B) from the EAS tag 1. For example, the detaching device may include a magnet 190 (FIGS. 3A-6, and 8), which may further provide an additional security feature and/or step to remove the EAS tag 1. In another example, the magnet 190 may provide a magnetic force to a ferrous portion or magnet within the tag body (e.g., tag 1 in FIGS. 1A and 1B), thus causing the tag body 1A to be pulled into the concave portion 108 of the device.

The foregoing description of various aspects and examples have been presented for purposes of illustration and description. It is not intended to be exhaustive nor to limit the disclosure to the forms described. The embodiment (s) illustrated in the figures can, in some instances, be understood to be shown to scale for illustrative purposes. Numerous modifications are possible in light of the above teachings, including a combination of the abovementioned aspects. Some of those modifications have been discussed and others will be understood by those skilled in the art. The various aspects were chosen and described in order to best illustrate the principles of the present disclosure and various aspects as are suited to the particular use contemplated. The scope of the present disclosure is, of course, not limited to the examples or aspects set forth herein, but can be employed in any number of applications and equivalent devices by those of ordinary skill in the art. Rather, it is hereby intended the scope be defined by the claims appended hereto.

What is claimed is:

1. A detaching device for releasing a tack body from a tag housing, the detaching device comprising:

a housing;

a handle pivotally mounted to the housing and configured to pivot about a handle axis;

a detacher movement mechanism configured to move a detacher portion from a first non-release position to a second release position, wherein the detacher movement mechanism converts rotational movement of the handle about the handle axis to rotational movement of the detacher portion about a first axis, wherein when the detacher portion moves to the second release position, the detacher portion is configured to be received by a receiving portion of the tag housing and release a locking mechanism inside the tag housing thus releasing the tack body from the tag housing.

2. The detaching device of claim 1, wherein the detacher movement mechanism comprises: a cam rotatably mounted to the housing and configured to rotate around a first axis, wherein the detacher portion is a hook mounted to the cam and configured to be received by the receiving portion of the tag housing, and a first angled camming surface that curves around the first axis;

a cam follower rotatably mounted to the handle, wherein pivoting of the handle about the handle axis causes the cam to rotate about the first axis due to a force applied to the first angled camming surface by the cam follower, wherein the rotation of the cam causes the hook to move from a first non-release position to the second release position.

3. The detaching device of claim 2, wherein the cam follower is a rolling element rotatably mounted to the handle and configured to rotate about a rolling element axis, wherein the cam follower is configured to roll along the first camming surface when the handle is rotated around the handle axis.

4. The detaching device of claim 2, wherein the cam and hook are biased toward the first non-release position via a biasing member.

5. The detaching device of claim 4, wherein the biasing member is a torsion spring.

6. The detaching device of claim 2, wherein the handle axis is substantially perpendicular to the first axis.

7. The detaching device of claim 2, further comprising a tag housing receiving portion and an interlock member moveable from a first position when a tag body is placed within the receiving portion and a second position when a tag body is removed from the receiving portion, wherein the when the interlock member is in the second position the interlock member prevents the handle from rotating about the handle axis and the cam from rotating about the first axis.

8. The detaching device of claim 7, wherein the interlock member is pivotally mounted to a portion of the housing and pivots about an interlock member axis from the first position to the second position.

9. The detaching device of claim 8, wherein when the interlock member is in the second position, the interlock member contacts the cam and prevents rotation of the cam and the handle.

10. The detaching device of claim 8, wherein when the interlock member is in the first position a receivable portion of the interlock member is slideably received within a receiving portion of the cam and allows the cam to rotate from the first non-release position to the second release position.

11. The detaching device of claim 1, wherein the detacher movement mechanism comprises a first gear operatively connected to the handle and a second gear operatively connected to the detacher portion, wherein rotation of the first gear causes rotation of the second gear causing the detacher portion to move from the first non-release position to the second release position.

12. A detaching device for releasing a tack body from a tag housing, the detaching device comprising:

a housing;

a hook configured to be movable from a first non-release position to a second release position, wherein in the second release position the hook is configured to be received by a hook receiving portion of the tag housing and release a locking mechanism inside of the tag housing thus releasing the tack body from the tag housing;

a handle moveably mounted to the housing, wherein movement of the handle causes the hook to move from the first non-release position to the second release position;

a tag housing receiving portion; and an interlock member moveable from a first position when the tag body is placed within the receiving portion to a second position when the tag body is removed from the receiving portion, wherein when the interlock member is in the second position the interlock member prevents the handle from moving and the hook from moving from the first non-release position to the second release position.

13. The detaching device of claim 12, further comprising:

a cam rotatably mounted to the housing and configured to rotate around a first axis, wherein the hook is mounted to the cam and is configured to rotate from the first non-release position to the second release position, wherein the cam further comprises an angled camming surface that curves around the first axis.

14. The detaching device of claim 13, wherein the handle is pivotally mounted to the housing and configured to pivot about a second axis, the handle further including a cam follower, wherein the movement of the handle causes the cam to rotate about the first axis due to a force applied to the camming surface by the cam follower.

15. The detaching device of claim 14, wherein the cam follower is a rolling element rotatably mounted to the handle and configured to rotate about a third axis, wherein the cam follower is configured to roll along the camming surface when the handle is rotated around the second axis.

16. The detaching device of claim 15, wherein the cam and hook are biased toward the first non-release position via a biasing member.

17. The detaching device of claim 16, wherein the when the interlock member is in the second position the interlock member prevents the handle from rotating about the second axis and the cam from rotating about the first axis.

18. The detaching device of claim 17, wherein the interlock member is pivotally mounted to a portion of the housing and pivots about an interlock member axis from the first position to the second position.

19. The detaching device of claim 18, wherein when the interlock member is in the second position, the interlock member contacts the cam and prevents rotation of the cam and the handle.

20. The detaching device of claim 19, wherein when the interlock member is in the first position a receivable portion of the interlock member is slideably received within a receiving portion of the cam and allows the hook to rotate from the first non-release position to the second release position.

* * * * *